United States Patent [19]

Carlough et al.

[11] Patent Number: 4,801,303

[45] Date of Patent: Jan. 31, 1989

[54] ONE-BATH DYEING OF POLYESTER-CELLULOSIC BLENDS USING DISPERSE AND SULFUR DYES

[75] Inventors: Mark S. Carlough, Concord; Laszlo A. Meszaros, Charlotte, both of N.C.

[73] Assignee: Sandoz Ltd., Basel, Switzerland

[21] Appl. No.: 57,068

[22] Filed: Jun. 1, 1987

[51] Int. Cl.[4] ..... D06P 3/82; C09B 49/00

[52] U.S. Cl. ..... 8/532; 8/585; 8/640; 8/642; 8/650; 8/651; 8/652

[58] Field of Search ..... 8/532, 640, 652, 642

[56] References Cited

U.S. PATENT DOCUMENTS 4,082,502 4/1978 von der Eltz et al. ..... 8/532
4,169,705 10/1979 Boyd et al. ..... 8/532
4,300,903 11/1981 Engelhardt et al. ..... 8/531
4,465,490 8/1984 von der Eltz ..... 8/400

FOREIGN PATENT DOCUMENTS 57-161176 10/1982 Japan .

*Primary Examiner*—A. Lionel Clingman
*Attorney, Agent, or Firm*—Gerald D. Sharkin; Richard E. Vila; Thomas C. Doyle

[57] ABSTRACT

Polyester-cotton blend textile substrates are dyed with a disperse dye and then with a sulfur dye from the same dyebath which is maintained at a temperature no higher than 105° C. when the sulfur dye is present therein and which preferably contains glucose as the reducing agent for the sulfur dye.

24 Claims, No Drawings

ONE-BATH DYEING OF POLYESTER-CELLULOSIC BLENDS USING DISPERSE AND SULFUR DYES

This invention relates to a method of dyeing substrates comprising blends of polyester and cellulosic fibers, wherein the polyester fibers are dyed with a disperse dye and the cellulosic fibers are dyed with a water-soluble or water-dispersible sulfur dye and said dyeings are effected in a single bath.

It is known to dye cellulosic substrates, e.g. cotton, with water-soluble sulfur dyes, i.e. dyes which are thiosulfonic acid derivatives of sulfur dyes. Such dyes in aqueous solution in the unreduced state have little, if any, substantivity for cellulose but are rendered substantive from an alkaline solution by the presence of a reducing agent.

It is also known to dye polyester/cotton blended cloth from a single dyebath containing both a disperse dye and a vat dye. Such dyeings are carried out at high temperature, e.g. 130°–150° C. and high pressure using glucose as the reducing agent for the vat dye.

We have discovered that under controlled dyeing conditions a polyester/cellulosic blend substrate can be dyed with a combination of a disperse dye and a water-soluble or water-dispersible sulfur dye so as to enable the dyer to employ the widest possible range of disperse dyes without concern about reducing the disperse dye.

Accordingly, this invention provides a method for the one-bath dyeing of a polyester-cellulosic blend substrate, which comprises exhaust dyeing said substrate with a disperse dye in an aqueous medium and subsequently exhaust dyeing said substrate with a water-soluble or water-dispersible sulfur dye in the same aqueous medium, which method is characterized in that the temperature of the aqueous medium is kept at or below 105° C. after the sulfur dye has been added thereto.

The substrate to be dyed according to this invention comprises a blend of polyester fibers and cellulosic, preferably cotton, fibers which may be in any proportion but are usually in a weight ratio in the range 80:20–20:80, more usually 65:35–35:65 polyester:cotton. The substrate may be in any of the usual textile forms, e.g. woven, knit, yarn etc.

The dyeing with the disperse dye, which effects the coloration of the polyester component of the substrate, may be carried out in conventional manner for exhaust dyeing with such a dye. Preferably, it is carried out at a pH in the range 4.5 to 6, more preferably 5.2 to 5.8 in the presence of carrier. It may be carried out under atmospheric conditions at a temperature in the range 90 to 100° C., preferably at the boil, or it may be carried out under superatmospheric conditions at a higher temperature, e.g. in the range 100° to 150° C., preferably 120° to 140° C..

It is an advantage of the present invention that the selection of a particular disperse dye is not critical. Rather, any disperse dye or mixture thereof normally used for the dyeing of polyester can be employed. In this regard, reference is made to the section entitled "Disperse Dyes" in the Colour Index, 3rd Edition (1971) and the various revisions and supplements thereof. The amount of such dye will be dictated by the shade and depth desired and is within the skill of the art to determine.

The pH of the dyebath for the disperse dyeing may be set withi any of the agents normally used for this purpose, e.g. acetic acid, formic acid, tartaric acid, sodium acetate or monosodium phosphate.

Similarly, the selection of a suitable dye carrier for the disperse dyeing is not critical. Such compounds are disclosed in the patent literature, e.g. U.S. Pat. Nos. 3,097,047; 3,203,753; 3,617,213; 3,728,078; 3,787,181 and 3,976,427, the disclosures of which are incorporated herein by reference. Examples of such compounds are biphenyl, lower alkylbiphenyls, mono-, di- and trichlorobenzene, alkyl benzoates, e.g. butyl benzoate, methylnaphthalenes, xylene, toluene and methly salicylate. As is also well documented in the patent literature, such compounds are often used with an emulsifying agent, which is preferably anionic or non-ionic.

The amount of carrier will vary, depending on the particular disperse dye, the dyeing conditions and the effectiveness of the particular carrier employed. It is well within the skill of the art to determine how much carrier is needed to give the desired yield for a given set of conditions. For high temperature dyeing a carrier may not be needed or may be used in an amount up to about 5%, e.g. 0.2 to 4% by weight, based on the weight of the substrate. For atmospheric dyeing the amount of carrier is normally in the range 3 to 12% by weight, based on the weight of the substrate being dyed.

As is also well known in the art, the dyeing time will vary depending on, among other things, the dyeing temperature and the rate of exhaustion of the particular disperse dyeing system employed. Usually the disperse dye, pH regulating agent and carrier dye are added to warm water and the resulting dyebath is then gradually heated to the final dyeing temperature at a rate such as to permit even dyeing of the substrate. The dyebath is maintained at the desired dyeing temperature long enough to ensure good exhaustion of the disperse dye from the dyebath onto the substrate. Typical dyeing times range from about 20 to 120 minutes, particularly 30 to 90 minutes, varying inversely with the dyeing temperature.

Following the dyeing of the polyester component with the disperse dye, the cellulosic component of the substrate is dyed in the same bath with a sulfur dye or mixture thereof under alkaline conditions in the presence of a reducing agent.

The sulfur dye(s) may be added to the dyebath prior to the dyeing with the disperse dye, when said dyeing is to be carried out at a temperature not exceeding 105° C., preferably not exceeding 100° C.. Otherwise, the sulfur dye is added after completion of the disperse dyeing and after cooling of the dyebath to 105° C. or below, usually to about 70° to 90° C.

Preferably, the dyebath is maintained at a temperature no higher than its atmospheric boiling point whenever the sulfur dye is present therein.

The sulfur dyes which can be used in the method of this invention are the water-soluble dyes referred to in the aforementioned Colour Index as "C.I. Solubilised Sulphur" dyes and water-dispersible sulfur dyes and sulfurized vat dyes which are in oxidized or partially oxidized state. The water-soluble dyes are characterized by the presence of at least one pendant thiosulfate group per molecule. The water-dispersible dyes are characterized by the presence of a thiol group in either the acid thiol form or alkali metal (e.g. sodium or potassium) salt form or by the presence of a thiocyano or disulfide group and are employed in the presence of a suitable dispersing agent, preferably an anionic surfactant such as sodium lignin sulfonate or a sulfonated naphthaleneformaldehyde condensate. Mixtures of such dyes can also be employed.

Reducing agents suitable for reducing sulfur dyes to make them substantive to cellulose are well known and include sodium hydrosulfite, sodium sulfide, sulphydrate (sodium hydrogen sulfide in water), sodium aldehyde sulfoxylate, thiourea dioxide and glucose. Of these glucose (e.g. dextrose) is preferred for the present invention.

The reducing agent is added to the dyebath after completion of the disperse dyeing and with the bath at a temperature no higher than 105° C., preferably about 75° to 85° C.. However, it is an advantage when using glucose that this preferred reducing agent can be conveniently added during the preparation of the disperse dyebath, since it is essentially inert under the disperse dyeing conditions described above.

The amount of reducing agent will depend on its reducing capacity and it is well within the skill of the art to determine how much of a particular reducing agent is required to reduce a particular sulfur dye. Typical amounts are in the range 2 to 16, preferably 6 to 12, grams per liter of dyebath.

In order to convert the sulfur dye to its cellulose-substantive reduced form, it is necessary that the dyebath be made alkaline, preferably to pH 11–13. For this purpose there is added to the dyebath an effective amount of a suitable alkali, such as sodium or potassium hydroxide or carbonate.

Preferably, a salt, such as sodium chloride or sodium sulfate, is added to the sulfure dyebath in an amount effective to increase the dyeing yield. This is advantageously done prior to the addition of the alkali. Preferably, the bath containing the sulfur dye(s) and the salt is held for a short period, e.g. 5 to 15 minutes, before the alkali is added. The amount of salt may vary over a wide range, e.g. 20 to 120 g/l, preferably 50 to 85 g/l.

Following the addition of the sulfur dye(s), reducing agent, alkali and, preferably, salt, the dyebath is held at a temperature of 70° to 90° C., preferably 75° to 85° C. for sufficient time to complete the dyeing of the cellulosic component of the substrate, usually about 10 to 120 minutes, preferably about 20 to 60 minutes.

In addition to the dyebath components specified above, other additives conventionally used in dyeing with disperse or sulphur dyes may also be employed, e.g. chelating agents such as ethylenediamine tetraacetic acid (EDTA), anti-foaming agents, leveling agents etc.

The dyeing may be carried out in a wide assortment of apparatus, depending on whether atmospheric or high temperature, high pressure conditions are to be employed. Such equipment includes winch becks, jet dyeing machines, beam and package dyeing machines and paddle dyeing machines.

The liquor:goods weight ratio is not critical and may vary over a wide range, e.g. 5:1 to 50:1, depending on the particular dyeing apparatus employed.

After the substrate has been dyed with the sulfur dye, it is rinsed and preferably treated with an aqueous solution of an oxidizing agent, such as hydrogen peroxide, sodium bichromate, sodium iodate or sodium bromate, preferably under mildly acetic conditions.

According to a first preferred embodiment of this invention, the following sequence is carried out:

1. Add to warm water an acidifying agent, dextrose, disperse dye(s), sulfure dye(s) and disperse dye carrier.
2. Heat to 100° C. and hold until disperse dyeing is complete.
3. Cool to 70° to 90° C..
4. Add salt.
5. Add sufficient alkali to give pH 11–13.
6. Hold at 75° to 85° C. to complete dyeing with sulfur dye(s) (about 10 to 120 minutes).
7. Rinse with water.

In a second preferred embodiment, the dyeing is effected in a pressurized vessel according to the following sequence:

1. Add to warm water an acidifying agent, dextrose, disperse dye(s) and carrier.
2. Heat to high-temperature dyeing temperature and hold until disperse dyeing is complete.
3. Cool to 70° to 90° C.
4. Add sulfur dye(s) and salt.
5. Add sufficient alkali to give pH 11–13.
6. Hold at 75°–85° C. until dyeing with sulfur dye(s) is complete (about 10 to 120 minutes).
7. Rinse with water.

In the following examples parts and percentages are by weight and temperature are in Centigrade degrees, unless otherwise stated.

EXAMPLE 1

One hundred parts of a 50:50 polyester/cotton blend fabric are introduced into a winch beck dyeing apparatus containing 1500 parts water at 49° C. To this are added 3 parts 56% acetic acid, 0.25part Sulfalox 100 (EDTA), 8 parts dextrose, 3 parts disperse dye carrier (trichlorobenzene-biphenyl plus emulsifier), 3 parts disperse dye (Sodyecron® Black BK) and 4.6 parts C.I. Solubilized Sulfur Black 2 (Sandozol® Black R). The resulting dyebath is heated gradually to boiling over a period of 30 minutes and held at the boil for 45 minutes. It is then cooled to about 80° C. while 80 parts of sodium sulfate are added. The resulting dyebath is held at about 80° C. for 10 minutes and then 8 parts of 50% aqueous sodium hydroxide are added and the dyebath is held at 80° C. for an additional 30 minutes. The dyebath is overflow rinsed with water until clear and then 0.5 part 56% acetic acid and 3 parts 35% hydrogen peroxide are added and the bath is held at 49° C. for 15 minutes. The bath is overflow rinsed again with water for 10 minutes, after which 1 part sodium carbonate is added and the bath is held at 49° C. for an additional 20 minutes. A full black union dyeing of the fabric is obtained.

EXAMPLE 2

Into a jet dyeing machine containing 1500 parts warm water (45°–60° C.) are introduced 100 parts 50:50 polyester/cotton blend fabric. To this are added 3 parts 56% acetic acid, 0.25 part EDTA (Sulfalox 100), 0.5 part carrier (trichlorobenzene-biphenyl with emulsifier), 2.4 parts C.I. Disperse Blue 55, 1.86 parts C.I. Disperse Orange 37 and 0.43 part C.I. Disperse Red 73. The dyebath is then gradually heated over 45 minutes to 130° C. and held at that temperature for 30 minutes. It is then cooled to 80° C. and there are added 4.6 parts C.I. Solubilized Sulfur Black 2 (Sandozol® Black R), 8 parts dextrose and 80 parts sodium sulfate. The dyebath is maintained at 80° C. for 10 minutes, then for an additional 20 minutes during which 4 parts sodium hydroxide flakes are slowly added, and then for an additional 20 during which 1 part sodium hydroxide flakes are added. The bath is then cooled to 70° C. and overflow rinsed until clear. Then 0.5 part 56% acetic acid and 1.5 parts 35% hydrogen peroxide are added and the bath is held at 49° C. for 15 minutes. The dyeing machine is emptied and then refilled with water to which is added 1 part sodium carbonate and 0.5 part nonionic scouring agent. The fabric is treated in the resulting bath for 10 minutes at 70° C. and then the bath is overflow rinsed until clear. One part sodium carbonate is added and the fabric is treated for an additional 15 minutes at 49° C. A full black union dyeing of the fabric is obtained.

EXAMPLE 3

The procedure of Example 2 is repeated, except that the dextrose is added to the initial dyebath prior to the dyeing with the disperse dye. Similar results are obtained.

We claim:

1. A method for the one-bath dyeing of a polyester-cellulosic blend substrate, which comprises exhaust dyeing said substrate with a disperse dye in an aqueous medium and subsequently exhaust dyeing said substrate with a water-soluble or water-dispersible sulfur dye under alkaline conditions and in the presence of a reducing agent in the same aqueous medium, said method being characterized in that the temperature of said aqueous medium is kept at or below 100° C. after the sulfur dye has been added thereto.

2. A method according to claim 1 wherein the sulfur dye is added to the aqueous medium prior to the dyeing of the substrate with the disperse dye and said dyeing with the disperse dye is effected at a temperature of 90° to 100° C.

3. A method according to claim 1 wherein the sulfur dye is added to the aqueous medium after the substrate has been dyed with the disperse dye.

4. A method according to claim 1 wherein the sulfur dye is a water-soluble sulfur dye.

5. A method according to claim 1 wherein the dyeing with the sulfur dye is carried out with an effective amount of glucose in the aqueous medium as a reducing agent for the sulfur dye.

6. A method according to claim 1 wherein the dyeing with the sulfur dye is effected at a temperature of 70° to 90° C.

7. A method according to claim 1 wherein the sulfur dye is a water-dispersible oxidized or partially oxidized sulfur dye or sulfurized vat dye containing at least one thiol, disulfide or thiocyano group.

8. A method according to claim 2 which comprises dyeing the polyester component of the substrate with the disperse dye in the aqueous medium which also contains the sulfur dye and glucose and then adding to said aqueous medium sufficient alkali to render the sulfur dye substantive for the cellulosic component of the substrate and dyeing said cellulosice component with said sulfur dye.

9. A method according to claim 3 wherein the substrate is dyed with the disperse dye at a temperature of 100° to 150° C.

10. A method according to claim 9 which comprises adding glucose to the dyebath prior to dyeing with the disperse dye and adding alkali after the addition of the sulfur dye and in an amount effective to render the sulfur dye substantive to the cellulosic component of the substrate.

11. A method according to claim 1 wherein the dyeing with the disperse dye is effected at a pH in the range 4.5 to 6.

12. A method according to claim 1 wherein the reducing agent is selected from the group consisting of sodium hydrosulfate, sodium sulfide, sulphhydrate, sodium aldehyde sulfoxylate, thiourea and glucose and is employed in an amount sufficient to reduce the sulfur dye.

13. A method according to claim 1 wherein the reducing agent is added to the dyebath after completion of the disperse dyeing and with the bath at a temperature no higher than 105° C. or, where the reducing agent is glucose, during the preparation of the disperse dyebath.

14. A method according to claim 1 which comprises rendering the sulfur dyebath alkaline by adding thereto an effective amount of sodium or potassium hydroxide or carbonate.

15. A method according to claim 2 wherein the dyeing with the disperse dye is effected at a pH in the range 4.5 to 6 and the dyeing with the sulfur dye is effected at a temperature of 70° to 90° C.

16. A method according to claim 3 wherein the dyeing with the disperse dye is effected at a pH in the range 4.5 to 6 and the dyeing with the sulfur dye is effected at a temperature of 70° to 90° C.

17. A method according to claim 2 wherein the dyeing with the sulfur dye is carried out with a water-soluble sulfur dye in the presence of an effective amount of glucose as reducing agent for said dye.

18. A method according to claim 3 wherein the dyeing with the sulfur dye is carried out with a water-soluble sulfur dye in the presence of an effective amount of glucose as reducing agent for said dye.

19. A method according to claim 8 wherein the dyeing with the sulfur dye is effected at a temperature of 70° to 90° C.

20. A method according to claim 10 wherein the dyeing with the sulfur dye is effected at a temperature of 70° to 90° C.

21. A method according to claim 15 wherein the dyeing with the sulfur dye is carried out with a water-soluble sulfur dye in the presence of an effective amount of glucose as reducing agent for said dye.

22. A method according to claim 16 wherein the dyeing with the sulfur dye is carried out with a water-soluble sulfur dye in the presence of an effective amount of glucose as reducing agent for said dye.

23. A method according to claim 19 which further comprises adding to the sulfur dyebath, prior to the addition of the alkali, sodium chloride or sodium sulfate in an amount effective to increase the dyeing yield.

24. A method according to claim 20 which further comprises adding to the sulfur dyebath, prior to the addition of the alkali, sodium chloride or sodium sulfate in an amount effective to increase the dyeing yield.

* * * * *